United States Patent [19]

Keenan et al.

[11] Patent Number: 4,727,286

[45] Date of Patent: Feb. 23, 1988

[54] ELECTRIC LAMP INCLUDING OXYGEN GETTER

[75] Inventors: James P. Keenan, Reading; Peter R. Gagnon, Georgetown, both of Mass.

[73] Assignee: GTE Products Corporation, Danvers, Mass.

[21] Appl. No.: 321,994

[22] Filed: Nov. 16, 1981

[51] Int. Cl.[4] ..... H01K 1/56

[52] U.S. Cl. ..... 313/557; 313/579; 313/578

[58] Field of Search ..... 252/181.5, 181.1; 313/557, 553, 562, 481, 546, 579

[56] References Cited

U.S. PATENT DOCUMENTS

| | | | |
|---|---|---|---|
| 975,040 | 11/1910 | Hopfelt | 252/181.5 X |
| 3,465,193 | 9/1969 | Beuvens et al. | 313/557 |
| 3,475,072 | 10/1969 | Graves | 252/181.1 X |
| 3,712,701 | 1/1973 | Johnston et al. | 313/557 X |
| 3,784,275 | 1/1974 | Wiedijk | 313/557 X |
| 4,032,808 | 6/1977 | Kischio | 313/557 |
| 4,039,879 | 8/1977 | T'jampens et al. | 313/579 |
| 4,099,081 | 7/1978 | Ainsworth | 313/562 |

*Primary Examiner*—David K. Moore
*Assistant Examiner*—K. Wieder
*Attorney, Agent, or Firm*—William H. McNeill; Carlo S. Bessone

[57] ABSTRACT

Electric incandescent lamp employing phosphine ($PH_3$) as the getter.

5 Claims, 1 Drawing Figure

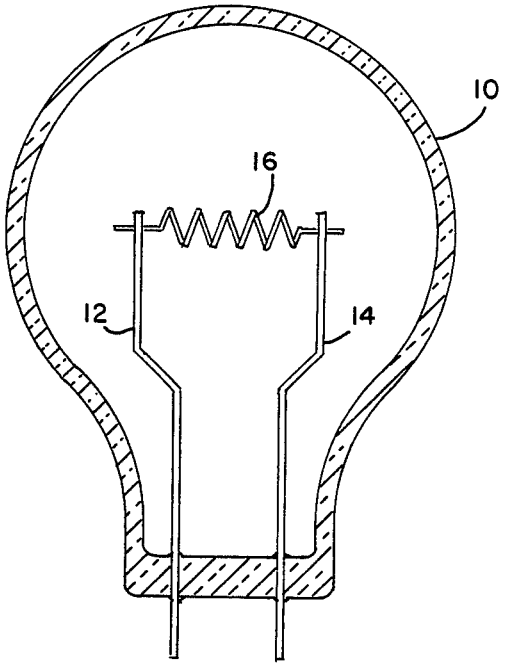
10
16
12
14

ELECTRIC LAMP INCLUDING OXYGEN GETTER

TECHNICAL FIELD

This invention relates to electric lamps. More particularly, it relates to such lamps of the incandescent variety which include an efficient oxygen getter.

BACKGROUND ART

The deleterious effects of oxygen in incandescent lamps is well known. To counteract these deleterious effects it also has long been known to include within such lamps an oxygen getter; i.e., a material which will preferentially combine with any free oxygen in the lamp.

Among usable getter materials for lamps, the benefits of phosphorous are well known, and many techniques and compounds have been employed in attempts to incorporate phosphorous into electric lamps.

For example, U.S. Pat. No. 3,475,072 suggests the use of triphosphorous penta-nitride ($P_3N_5$) in solid or slurry forms. U.S. Pat. No. 4,032,808 suggests the use of phosphorthionitride (PNS) which is to be mixed with a hydrocarbon solvent such as toluene. The mixture is applied to the filament or the supports therefor as a coating.

These methods require additional steps to include the phosphorous within the lamp and add to the cost thereof.

It would be a decided advance in the art to provide an improved system for incorporating a getter within a lamp.

DISCLOSURE OF THE INVENTION

It is, therefore, an object of this invention to obviate the disadvantages of the prior art.

It is another object of the invention to provide an improved getter for electric lamps.

Yet another object of the invention is the provision of a getter which can be easily and economically inserted into an electric lamp.

These objects are accomplished, in one aspect of the invention, by the provision of an electric incandescent lamp which has a closed envelope. The envelope contains an incandescent filament mounted between a pair of supports and a gaseous oxygen getter comprising phosphine ($PH_3$).

The phosphine can be introduced into the lamp as part of the conventional filling cycle, thus eliminating any extra steps in the manufacture.

BRIEF DESCRIPTION OF THE DRAWING

The single figure illustrates a diagrammatic electric incandescent lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Phosphine ($PH_3$) is a gas having a vapor pressure of 594 p.s.i.g. It can be employed as a getter in vacuum incandescent lamps and gas filled incandescent lamps where the fill comprises one or more of nitrogen, neon, argon, krypton or xenon. The phosphine is equally advantageously employed in tungsten halogen lamps exhibiting the well known halogen cycle. In these latter lamps the halogen/phosphorous ratio can be easily controlled to any desired level.

Further, in any gas filled lamp (with or without a halogen) the phosphine can be mixed in any desired quantity with the fill gas supply, thus insuring its inclusion in the lamps during the filling operation and eliminating a separate operation and reducing the cost of the lamp.

As represented by the figure, lamps employing this invention include a closed envelope 10 having supports 12 and 14 sealed therein. The supports 12 and 14 carry a filament 16 mounted therebetween of a suitable material, such as tungsten.

While there have been shown what are at present considered to be the preferred embodiments of the invention, it will be apparent to those skilled in the art that various changes and modifications can be made herein without departing from the scope of the invention as defined by the appended claims.

We claim:

1. An electric incandescent lamp having a closed envelope, said envelope containing a filament mounted therein; and a gaseous oxygen getter within said envelope, said oxygen getter comprising phosphine.

2. The lamp of claim 1 wherein said envelope contains a substantial vacuum.

3. The lamp of claim 1 wherein said envelope includes a substantially inert fill gas.

4. The lamp of claim 3 wherein said substantially inert fill gas is selected from one or more of the group consisting of nitrogen, neon, argon, krypton and xenon.

5. The lamp of claims 1, 2, 3 or 4 wherein said envelope contains a sufficient amount of halogen to allow said lamp to function with a tungsten-halogen cycle.

* * * * *